US009070309B2

(12) United States Patent
Proctor

(10) Patent No.: US 9,070,309 B2
(45) Date of Patent: Jun. 30, 2015

(54) FLAGPOLE SYSTEM PROVIDING HALF-MAST DISPLAY MODE

(76) Inventor: Robert D. Proctor, Hudson, WI (US)

( * ) Notice: Subject to any disclaimer, the term of this patent is extended or adjusted under 35 U.S.C. 154(b) by 284 days.

(21) Appl. No.: 13/608,664

(22) Filed: Sep. 10, 2012

(65) Prior Publication Data

US 2013/0061797 A1 Mar. 14, 2013

Related U.S. Application Data

(60) Provisional application No. 61/532,304, filed on Sep. 8, 2011.

(51) Int. Cl.
*G09F 17/00* (2006.01)

(52) U.S. Cl.
CPC ..... *G09F 17/00* (2013.01); *G09F 2017/0025* (2013.01)

(58) Field of Classification Search
CPC ..... E04H 12/32; G09F 17/00; G09F 17/0091; G09F 2017/0025; G09F 2017/005
USPC ..... 116/173, 174, 175; 248/125.8; 403/109.2, 109.3, 109.5, 109.6
See application file for complete search history.

(56) References Cited

U.S. PATENT DOCUMENTS

| | | | | |
|---|---|---|---|---|
| 556,614 | A | 3/1896 | Cabell | |
| 765,427 | A | 7/1904 | Herrick | |
| 844,492 | A | 2/1907 | Beidler | |
| 918,579 | A * | 4/1909 | Murch | 248/353 |
| 928,312 | A * | 7/1909 | Lloyd | 401/117 |
| 1,020,396 | A | 3/1912 | Blank | |
| 1,236,417 | A * | 8/1917 | Finn | 116/174 |
| 1,267,915 | A * | 5/1918 | Shellabarger | 294/57 |
| 1,365,851 | A * | 1/1921 | Reynolds | 403/107 |
| 1,547,416 | A | 7/1925 | Edwards | |
| 1,575,040 | A | 3/1926 | Crum | |
| 2,229,475 | A * | 1/1941 | Redmer | 248/188.5 |
| 2,319,992 | A * | 5/1943 | Hubbard | 294/174 |
| 2,440,500 | A | 4/1948 | Ellis | |
| 2,507,623 | A | 5/1950 | Diaz | |
| 2,527,357 | A | 10/1950 | Donahey | |
| 2,775,221 | A | 12/1956 | Olson | |
| 3,242,901 | A | 3/1966 | Olson | |
| 3,323,486 | A | 6/1967 | Woolf | |
| 3,396,695 | A | 8/1968 | Milburn | |
| 3,418,967 | A | 12/1968 | Donkersloot | |
| 3,474,833 | A * | 10/1969 | Garrette, Jr. et al. | 138/120 |
| 3,587,520 | A | 6/1971 | Miller | |
| 3,599,599 | A | 8/1971 | Jones | |
| 3,675,615 | A | 7/1972 | Stangarone et al. | |
| 3,680,526 | A | 8/1972 | Buffington, Jr. | |
| 3,933,117 | A * | 1/1976 | Maietta | 116/28 R |
| 5,044,301 | A | 9/1991 | Peters | |
| 5,253,608 | A * | 10/1993 | Burke | 116/173 |

(Continued)

FOREIGN PATENT DOCUMENTS

| | | | |
|---|---|---|---|
| EP | 848778 A1 | 6/1998 | |
| FR | 2987389 A1 * | 8/2013 | E04H 12/34 |

(Continued)

*Primary Examiner* — R. A. Smith

(57) ABSTRACT

A flag mounting system provides a compact flagpole that may be mounted on a vertical surface or the like. A sliding tubular sleeve on the flagpole supports the flag and in a half-mast position exposes a distal end of the flagpole which is painted black. When the sliding tubular sleeve is extended to a full extension position, this black portion is covered.

8 Claims, 4 Drawing Sheets

(56) References Cited

U.S. PATENT DOCUMENTS

| | | | | |
|---|---|---|---|---|
| 5,364,074 | A | 11/1994 | Gourley | |
| 5,572,835 | A | 11/1996 | Atkins et al. | |
| 6,213,672 | B1 * | 4/2001 | Varga | 403/109.2 |
| 6,371,686 | B1 * | 4/2002 | Wu | 403/377 |
| 6,390,017 | B1 | 5/2002 | Hendrickson et al. | |
| 6,676,326 | B2 * | 1/2004 | Wu | 403/329 |
| 6,854,916 | B2 * | 2/2005 | Hsieh | 403/109.3 |
| 7,004,104 | B1 * | 2/2006 | Kundus | 116/173 |
| 7,007,952 | B2 | 3/2006 | Nelson | |
| 7,066,676 | B2 * | 6/2006 | Tsai | 403/109.3 |
| 7,231,884 | B1 | 6/2007 | Rang | |
| 7,530,325 | B2 | 5/2009 | Swenson et al. | |
| 7,967,259 | B2 * | 6/2011 | Nakatani | 248/125.8 |
| 8,066,445 | B2 * | 11/2011 | Kwak et al. | 403/109.3 |
| 8,297,216 | B1 * | 10/2012 | Janton | 116/173 |
| 2003/0218302 | A1 | 11/2003 | Nelson | |
| 2005/0284357 | A1 | 12/2005 | Vazvan et al. | |
| 2007/0006794 | A1 | 1/2007 | Swenson et al. | |
| 2010/0101479 | A1 * | 4/2010 | Grahl et al. | 116/173 |
| 2010/0122652 | A1 | 5/2010 | Schofield | |
| 2010/0175288 | A1 | 7/2010 | Engler | |
| 2011/0139058 | A1 | 6/2011 | Sanvik | |
| 2012/0014104 | A1 | 1/2012 | Morris et al. | |

FOREIGN PATENT DOCUMENTS

| | | | |
|---|---|---|---|
| WO | 9709500 | A1 | 3/1997 |
| WO | 9721205 | A1 | 6/1997 |
| WO | 2002043039 | A1 | 6/2002 |
| WO | 03091968 | A1 | 11/2003 |
| WO | 2004113649 | A2 | 12/2004 |
| WO | 2010016788 | A1 | 2/2010 |

* cited by examiner

FLAGPOLE SYSTEM PROVIDING HALF-MAST DISPLAY MODE

CROSS REFERENCE TO RELATED APPLICATION

This application claims the benefit of U.S. provisional application 61/532,304 filed Sep. 8, 2011 and hereby incorporated by reference in its entirety.

BACKGROUND OF THE INVENTION

The present invention relates generally to flagpoles and specifically to a flagpole system for providing a half-mast display of the flag.

The display of the flag of one's country is a popular way to express patriotic feelings. A common way of displaying a flag uses a freestanding vertical flagpole, for example, having a halyard system allowing the flag to be raised and lowered, for example, at dawn and dusk.

A popular alternative to a freestanding vertical flagpole is a shortened flagpole that may be mounted on a vertical surface of a building wall or the like to extend upward at an angle. These wall-mounted flagpoles largely eliminate the complexity of a halyard system for raising and lowering the flag and may simply use clips attached in separation on the flagpole itself and that may be attached to loops or grommets in the flag. The fixed separation of the clips on such flagpoles hold the flag open without the need for the weight of the halyard or other weighting system. Often, these clips are mounted to the flagpole to rotate about the flagpole thereby preventing the flag from winding itself around the flagpole in the wind.

Often it is desired to fly a flag at "half-mast" as a symbol of respect or mourning. This symbolic gesture presupposes a flag mounted on a freestanding vertical flagpole and is difficult to implement on an angled flagpole attached to a building, both because of the reduced length of such a flagpole and because of the fixed mounting clips which may provide only a single mounting location.

SUMMARY OF THE INVENTION

The present invention provides a flagpole system for use with flags mounted on a shortened flagpole attached to a building or the like. The flag is attached to a tubular collar that may slide along the flagpole moving between two detent positions representing a full elevation and half-mast position. A distal end of the flagpole is colored black to be hidden by the tubular collar when the flag is in the full elevation position but exposed at the half-mast position emphasizing this latter state.

Specifically the invention provides a flag pole system including a flagpole having a proximal end and a distal end, the latter providing an axial portion darkened with respect to a proximal portion of the flagpole. A tubular sleeve sized to fit over the flagpole may slide axially therealong between a first position covering the upper axial portion of the flagpole and a second position uncovering the upper axial portion of the flagpole, the tubular sleeve providing a first and second mounting element for attaching to adjacent vertices of the flag.

It is thus a feature of at least one embodiment of the invention to provide for a symbolic representation of respect or mourning in a shortened flagpole of the type that may be conveniently mounted on a vertical wall or other surface. The combination of downward movement of the flag and additional emphasis provided by the darkened upper section of the flagpole revealed after this downward motion provides an immediate visual analog to a conventional half-mast display.

The flagpole system may further include first and second detents positioned between the flagpole and a tubular sleeve for releasably holding the tubular sleeve in either of the first and second positions.

It is thus a feature of at least one embodiment of the invention to provide for simplified repositioning of the flag for half-mast display that does not require disconnecting the flag from the flagpole system.

The detents may releasably lock axial movement of the tubular sleeve on the flagpole while permitting rotational movement of the tubular sleeve on the flagpole.

It is thus a feature of at least one embodiment of the invention to provide the aforementioned benefits while reducing any tendency for the flag to wrap around the flagpole, such as may be relieved by rotation of the tubular sleeve around the flagpole.

The first and second mounting elements may be clips adapted to releasably engage grommets in the flag.

It is thus a feature of at least one embodiment of the invention to provide a flagpole system that may be used with common flag types suitable for both wall-mounted and freestanding vertical flagpoles.

The tubular sleeve may include a cylindrical tube received between collars at distal and proximal ends of the cylindrical sleeve, the collars each presenting an internal circumferential channel and the detent may provide a spring loaded button that may extend into the channel from the flagpole to releasably retain the collar by interengagement of the channel and button.

It is thus a feature of at least one embodiment of the invention to provide for a simple and reliable detent system that is easy to manufacture.

The channel may include a first wall sloped with respect to an axis of the tubular sleeve and a second wall substantially perpendicular to an axis of the tubular sleeve to preferentially allow disengagement of the button from the channel only with motion of the cylindrical tube away from the button.

It is thus a feature of at least one embodiment of the invention to provide both a detent system and positive stop system for allowing the user to properly position the flag in the two positions of fully extended and half-mast without the need for careful adjustment.

The collars may include radially extending flanges having loops formed therein for attachment to clips that may attach to grommets of the flag.

It is thus a feature of at least one embodiment of the invention to concentrate design features on a single part of the collar which may provide for the detent, stop, and flag attachment point and which may be combined with other simple manufactured shapes to revive the present invention.

These particular objects and advantages may apply to only some embodiments falling within the claims and thus do not define the scope of the invention.

DETAILED DESCRIPTION OF THE PREFERRED EMBODIMENT

Figure 1:
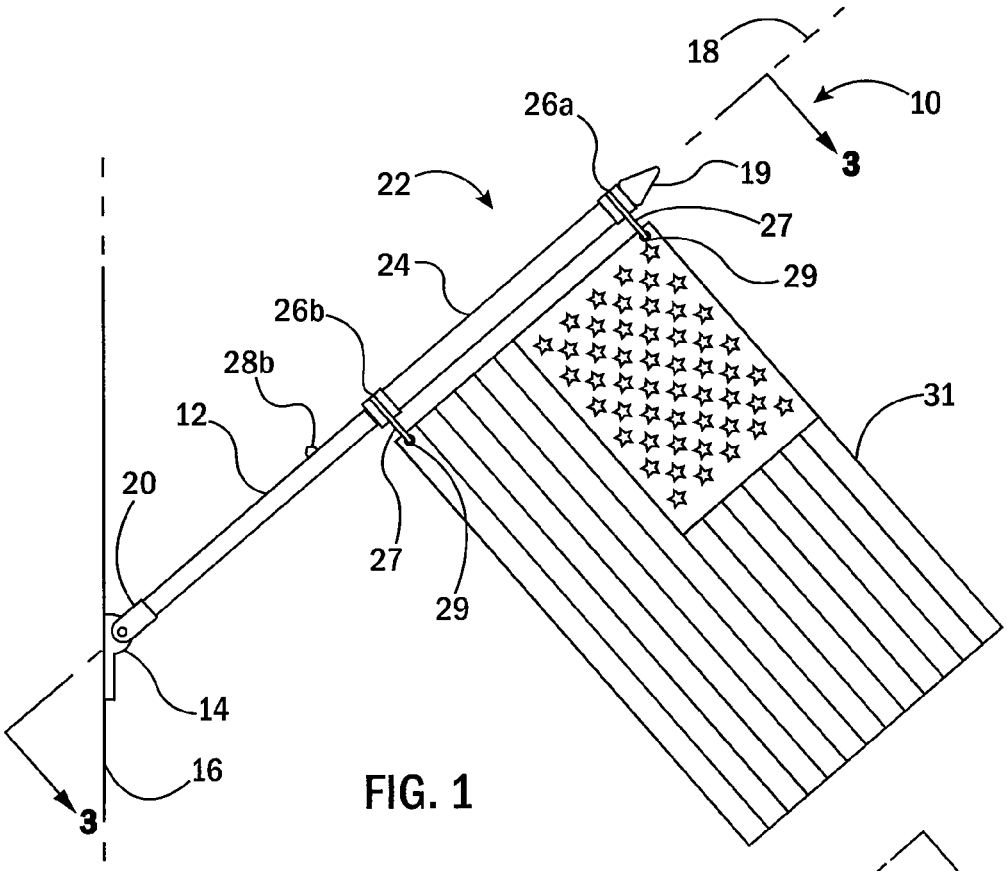
FIG. 1 is a simplified side elevational view of a flag attached to the flagpole system of the present invention with the flag in a full elevation position as attached to a tubular sleeve which may slide up along a flagpole to reach this position.

Referring now to FIG. 1, a flag mounting system 10 of the present invention provides a flagpole 12 that may be attached at a proximal end, by a mounting bracket 14, to a vertical surface 16 such as a wall or post or other similar structure so that the flagpole 12 extends along an axis 18 generally at an angle with respect to vertical, for example, 45 degrees. A distal end of the flagpole 12 maybe capped with a finial 19 or the like.

The flagpole 12 may, for example, be a generally cylindrical tube, for example, a plastic or metal pipe or the like that may have a protective surface coating or paint as will be described. The bracket 14 may provide for an adjustment of the angle of the axis 18 through a pivot point 20 according to techniques well known in the art. The bracket 14 may be generally screwed or bolted to the vertical surface 16 and may provide for a cylindrical bore receiving the proximal end of the flagpole 12 possibly including a set screw or other mechanism to retain the two together.

A tubular sleeve 22 having an axial length less than the length of the flagpole 12 may be positioned around the flagpole 12. In this regard, the tubular sleeve 22 may have an internal diameter closely approximating the external diameter of the flagpole 12 allowing free axial motion between the two and allowing the tubular sleeve 22 to rotate freely about the axis 18.

In one embodiment, the tubular sleeve 22 may be constructed of a central cylindrical tube 24, for example a plastic or metal material, flanked at either end by collars 26*a* and 26*b*. Each of the collars 26*a* and 26*b* may in turn support mounting clips 27 to releasably attach to grommets 29 in the upper left and lower left corners of a flag 31.

The flagpole 12 may include two detent buttons 28*a* and 28*b* (the former not visible in FIG. 1) retractably protruding from a surface of the flagpole 12 and axially spaced at a separation greater than the length of the tubular sleeve 22. In this way, the tubular sleeve 22 may be moved axially upward along the flagpole 12 to a full extension position with collar 26*b* closely proximal to finial 19 and engaging the upper detent button 28*a* and with collar 26*b* displaced upward from a detent button 28*b* as will be described below.

Figure 2:
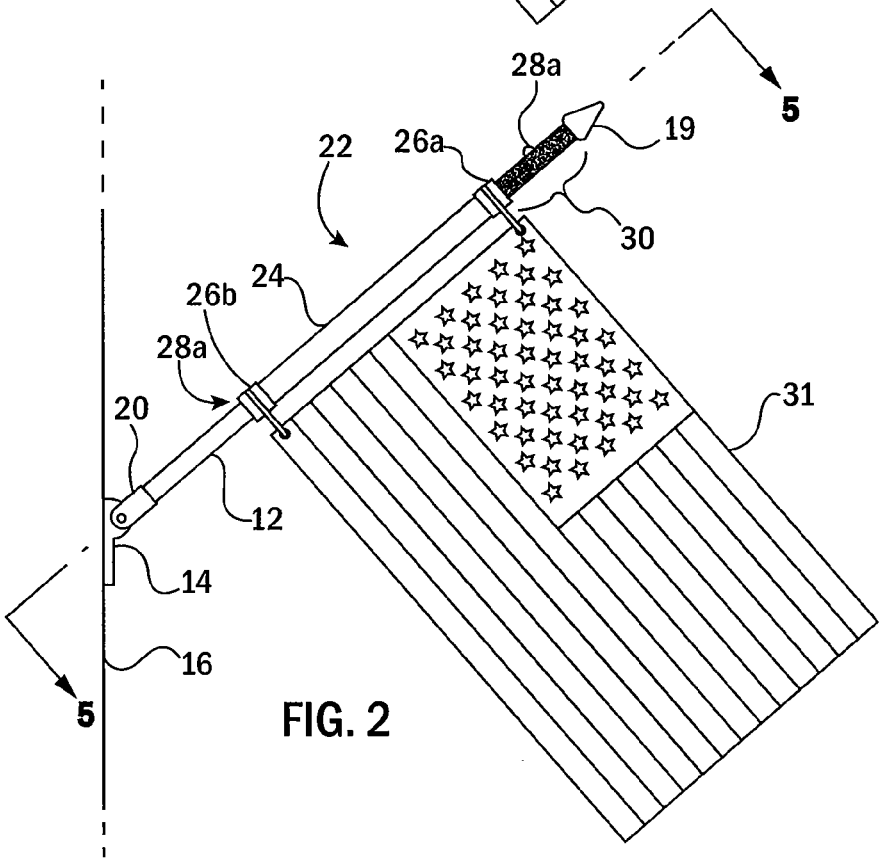
FIG. 2 is a figure similar to that of FIG. 1 showing the flag in a half-mast position obtained by moving the tubular sleeve down the flagpole to expose a black portion of an upper end of the flagpole.

Alternatively, and referring to FIG. 2, the tubular sleeve 22 may be moved axially downward to the half-mast position so that collar 26*b* engages the detent button 28*b* and collar 26*a* is removed downward from the finial 19 and removed from detent button 28*a*. In this half-mast position, the tubular sleeve 22 uncovers an upper portion 30 of the flagpole 12 at a distal end of the flagpole 12. This upper portion 30 of the flagpole 12 is painted or otherwise colored black so as to provide a strong visual indication of the half-mast position of the flag 31 despite the relatively minor displacement of the tubular sleeve 22 and flag 31. The remainder of the flagpole 12 may, for example, be colored silver or white to provide a strong contrast with the upper portion 30.

Figure 3:
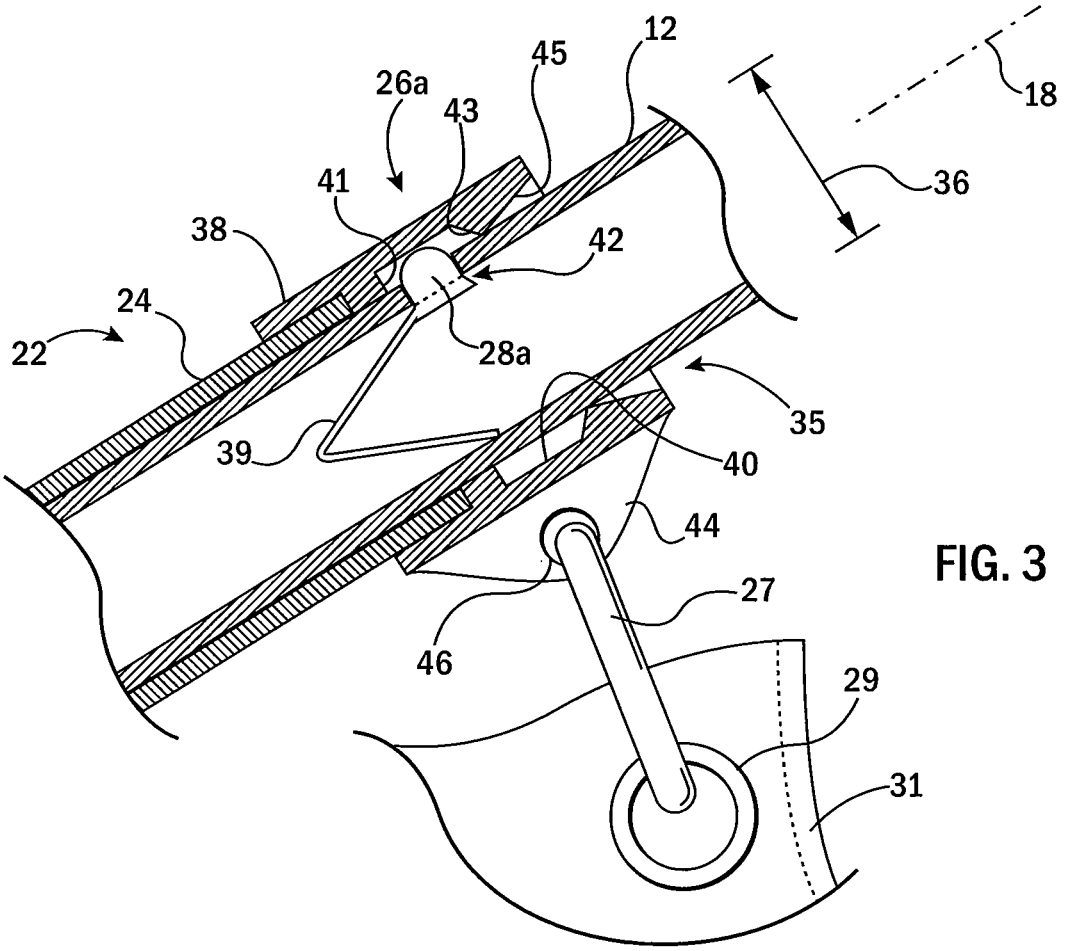
FIG. 3 is a fragmentary cross-sectional view along line 3-3 of FIG. 1 showing one end of the tubular sleeve formed of an inter-fitting of a cylindrical tube and a collar, the latter having an internal circumferential groove receiving a button of a spring-loaded detent retaining the collar at the detent position.
Figure 4:
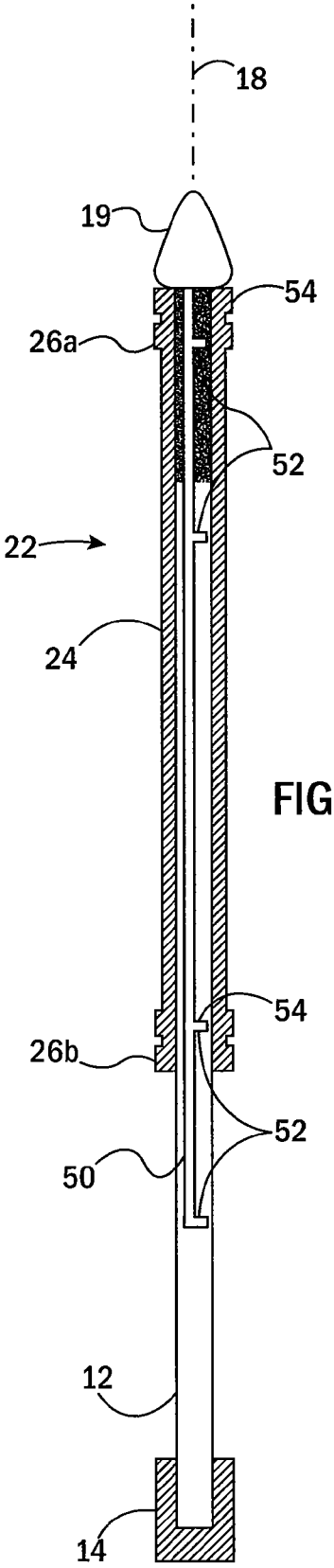
FIGS. 4 and 5 are cross-sectional views along lines 3-3 and 5-5 of FIGS. 1 and 2 respectively, showing an alternative embodiment in which an inwardly projecting tooth at the collars of the tubular sleeve may engage and lock with a groove in the flagpole.
Figure 5:
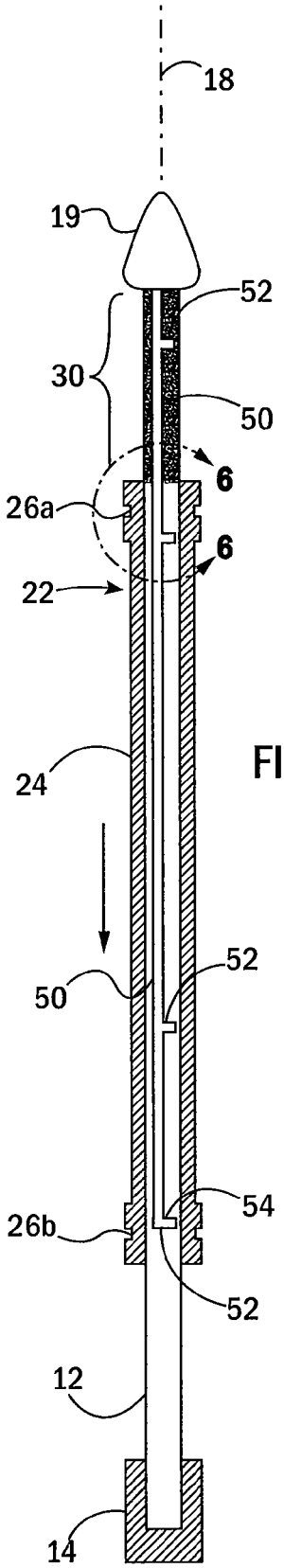

Referring now to FIG. 3, the collar 26*a* (and collar 26*b* which is substantially identical but rotated 180 degrees with respect to the cylindrical tube 24) may provide for an inner axial bore 35 having a diameter 36 sized to freely pass the outside diameter of the flagpole 12. A counterbore 38 on an inner end of the collar 26*a* may provide a socket receiving a corresponding end of the cylindrical tube 24 which when so received may abut against a bottom of the counterbore 38.

Beyond the counterbore 38, moving upward through the collar 26*a* away from the cylindrical tube 24, the collar 26*a* presents a circumferential inner groove 40 opening at an inner surface of the collar 26*a* extending radially into the collar 26. This circumferential inner groove 40 is sized to receive and capture a corresponding detent button 28*a* when the collar 26*a* is in the upper extended position over the detent button 28*a*. The detent button 28*a* is radially spring biased outward by a V-shaped spring clip 39 (and may be a drawn portion of that spring clip 39), the latter which may slide into the tube of the flagpole 12 and be retained by loose engagement between the detent button 28*a* and a hole 42 in the wall of the flagpole 12 at the position of the detent.

A lower wall 41 of the circumferential groove 40 may be substantially perpendicular to the axis 18 to provide a stop surface that tends not to inwardly compress the detent button 28*a* and thus block further upward motion of the tubular sleeve 22 in the manner of a physical stop. On the other hand, the upper wall 43 of the circumferential groove 40 is preferably angled with respect to the axis 18, for example, by approximately 45 degrees, to allow downward pressure on the tubular sleeve 22 to compress the detent button 28*a* inwardly allowing the cylindrical tube 24 to slide downward with modest pressure. An upward opening edge 45 of the collar 26*a* is likewise beveled (albeit in the opposite direction) to allow compression of the detent button 28*a* inwardly when the cylindrical tube 24 is moved upward to engage the detent button 28*a*.

In this way the groove 40 and detent button 28*a* provide a releasable detent tending to hold the cylindrical tube 24 upward in the full extension position but allowing its ready retraction by force on the tubular sleeve 22 by a user.

It will be appreciated that the same description applies to the collar 26*b* and detent button 28*b* albeit with respect to holding the tubular sleeve 22 in the half-mast position.

An outer surface of the collar 26*a* (and collar 26*b*) provides a radially and axially extending flange 44 having a hole 46 that may attach to a spring clip 27. The latter spring clip 27 may be releasably clipped to a grommet 29 in the flag 31 as described above.

It will be appreciated that the circumferential groove 40 while capturing the detent button 28*a* to resist axial movement, allows rotation of the tubular sleeve 22 about the axis 18 freely so that the flag 31 may resist wrapping around the flagpole 12.

The collars 26*a* and 26*b* may be advantageously identical and injection molded from a thermoplastic and attached to the cylindrical tube 24 using adhesive or the like.

Referring now to FIGS. 4, 5, 6 and 7, in an alternative embodiment, the flagpole 12 may be given an axial groove 50 that may pass partially into a solid flagpole 12 or partially through a tubular flagpole 12. Circumferentially directed branch grooves 52 may join the groove 50 at four locations spaced apart along the groove 50.

In this embodiment, each collar 26 may provide for an inwardly extending tooth 54 that may engage the groove 50 to allow free movement of the cylindrical tube 24 axially along axis 18 when the tooth 54 is engaged in the groove 50. At the four locations of the branch grooves 52, however, a quarter turn rotation of the cylindrical tube 24 will cause the tooth 54 to pass into those branch grooves 52 blocking the cylindrical tube 24 against axial movement until it is rotated back with the tooth 54 engaged in the groove 50. The four locations of the branch grooves 50 are sized to allow tooth 54 on both of the collars 26*a* and 26*b* to engage corresponding branch grooves 52 at half-mast and full extension positions.

Figure 6:
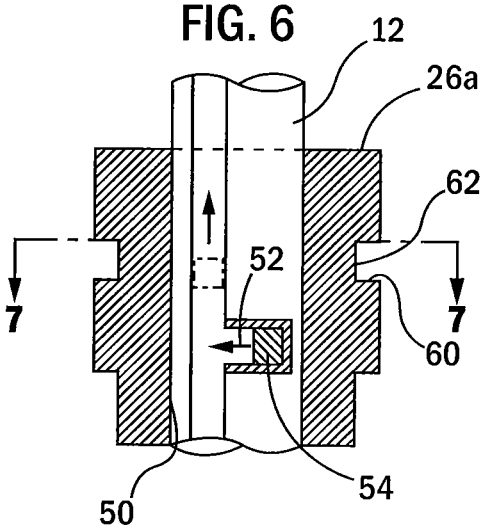
FIG. 6 is a fragmentary detail cross-section of the collar showing locking of the collar to the flagpole by quarter turns of the collar with respect to the flagpole.
Figure 7:
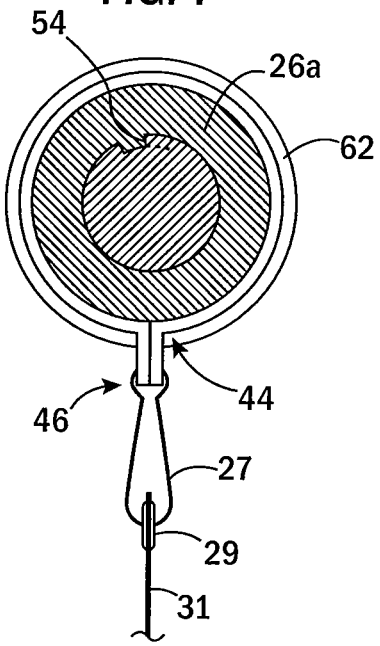
FIG. 7 is a cross-section along line 7-7 of FIG. 6 showing the attachment of the flag to a ring which may rotate about the collar of FIG. 6.

Referring now to FIG. 6 in this embodiment, the collars 26 are not free to fully rotate about the flagpole 12 and accordingly an outer circumferential groove 60 may be provided in each collar 26 that may receive a ring 62 that may rotate within the groove 60 about the collar 26 and which provides mounting flange 44 and hole 46 to attach to spring clip 27 and which allows the necessary freedom of rotation to prevent wrapping up the flag about the flagpole 12.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications are hereby incorporated herein by reference in their entireties.

I claim:

1. A flagpole system comprising:

a flagpole having a proximal end and a distal end, the latter providing an upper axial portion darkened with respect to a proximal portion of the flagpole; and a tubular sleeve sized to fit over the flagpole and slide axially therealong between a first position covering the upper axial portion of the flagpole and a second position uncovering the upper axial portion of the flagpole, the tubular sleeve providing a first and second mounting element for attaching to adjacent corners of the flag;

wherein the tubular sleeve comprises a cylindrical tube received between collars at distal and proximal ends of the cylindrical sleeve, the collars each presenting an internal circumferential channel and wherein the detents provide a spring loaded button that may extend into the channel from the flagpole to releasably retain the collar by interengagement of the channel and button.

2. The flagpole system of claim 1 further including a first and second detent positioned between the flagpole and the tubular sleeve for releasably holding the tubular sleeve in either of the first and second positions.

3. The flagpole system of claim 2 wherein the detents releasably block axial movement of the tubular sleeve on the flagpole while permitting rotational movement of the tubular sleeve on the flagpole.

4. The flagpole system of claim 3 wherein the first and second mounting elements are clips adapted to releasably engage grommets in the flag.

5. The flagpole system of claim 1 wherein the channel includes a first wall sloped with respect to an axis of the tubular sleeve and a second wall substantially perpendicular to an axis of the tubular sleeve to preferentially allow disengagement of the button from the channel only with motion of the cylindrical tube away from the button.

6. The flagpole system of claim 5 wherein the collars include radially extending flanges having loops formed therein for attachment to clips that may attach to grommets of the flag.

7. The flagpole system of claim 1 further including an angle bracket attachable to a proximal end of the flagpole and having a mounting face angled with respect to an axis of the flagpole for attachment to a vertical wall for supporting the flagpole at approximately 45 degrees from vertical.

8. The flagpole system of claim 1 further including a flag attached to the tubular sleeve by the first and second mounting elements.

* * * * *